United States Patent [19]

Ballantine

[11] Patent Number: 4,472,149

[45] Date of Patent: Sep. 18, 1984

[54] SHIP

[76] Inventor: James S. Ballantine, 121 N. Shore Rd., Absecon, N.J. 08201

[21] Appl. No.: 369,185

[22] Filed: Apr. 16, 1982

[51] Int. Cl.[3] ..... B63H 5/12

[52] U.S. Cl. ..... 440/58; 114/69

[58] Field of Search ..... 114/56, 57, 65 R, 68, 114/69, 355, 356, 357, 358, 359; 440/38–47, 53–56, 58–63; 415/DIG. 1; 239/265.19, 265.25, 265.27; 60/221, 222

[56] References Cited

U.S. PATENT DOCUMENTS

| | | | |
|---|---|---|---|
| 2,308,820 | 1/1943 | McQuerry | 114/69 |
| 2,848,155 | 8/1958 | Hausmann | 415/DIG. 1 |
| 3,807,347 | 4/1974 | Baldwin | 440/54 |
| 4,032,689 | 6/1977 | Johnson et al. | 114/355 |

FOREIGN PATENT DOCUMENTS

| | | | |
|---|---|---|---|
| 126047 | 5/1919 | United Kingdom | 114/68 |

*Primary Examiner*—Trygve M. Blix
*Assistant Examiner*—Jesûs D. Sotelo
*Attorney, Agent, or Firm*—Thomas C. Naber

[57] ABSTRACT

A water-going vessel propelled via a plurality of parallel sets of two underwater turbines disposed along the underside of said vessel, with each turbine mounted on respective retractable struts. A plurality of sets of turbines extend from respective turrets disposed along the longitudinal midline of the underside of the vessel, each of said turrets rotatable through 360 degrees and each having extending therefrom one turbine set. Hull construction pieces of the vessel preferably comprise an outer and an inner containment wall within which a plurality of touching hollow spheres are sandwiched and wherein a plurality of individual lengths of high strength sheaths are within respective tubes which are parallel with the containment walls and disposed within intrices formed by the spheres. The individual lengths of sheaths are connectable to each other to form a network of sheaths encircling the hull. Stress can be introduced and adjusted within each length of sheath which is a part of the network. Also disclosed is an improved underwater turbine, wherein the improvement comprises a plurality of housings surrounding respective portions of the turbine, with each of said housings having therein rotatable blades and, immediately rearward of said blades, a plurality of nozzle openings through which a gas under pressure can exit in a path of flow directed along the outer wall of said turbine.

6 Claims, 9 Drawing Figures

SHIP

BACKGROUND OF THE INVENTION

This invention relates to a trubine driven water-going vessel having turret mounted turbines to effectuate steering and total vessel movement in virtually any direction.

Usually steering means employed in changing direction of a water-going vessel is the traditional rudder system disposed on the underside of said vessel. While such a rudder system eventually accomplishes directional change, it does not have the capability to rapidly alter the course of a vessel. This lack of capability is especially critical in larger ships. Further, of course, a rudder does not have any capability to move the total vessel sideways, resulting in a lack of maneuverability of the vessel during docking procedures or in emergency situations where lateral or other total movement would be advantageous.

In my copending application Ser. No. 185,940, filed Sept. 10, 1980, now U.S. Pat. No. 4,389,197 issued June 21, 1983 and incorporated herein by reference, I describe a high speed vessel which utilizes underwater turbines for propulsion and attainment of high velocity. The instant application discloses a ship utilizing similarly-constructed turbines, but additionally provides for directional movement and travel of the total ship in any direction.

SUMMARY OF THE INVENTION

The subject of the instant invention is a water-going vessel having self-propulsion means comprising a plurality of parallel sets of two underwater turbines disposed along the underside of the vessel wherein each turbine is mounted at the end of individual retractable struts so that each turbine of each set is spaced equidistantly on opposite sides from a point on the longitudinal midline of the underside of the vessel, and further having a plurality of respective sets of two turbines wherein each turbine is mounted on respective struts extending from respective turrets disposed along the longitudinal midline of the underside of the vessel, with each turret having extending therefrom one set of turbines and with each turret rotatable through 360 degrees. Struts extending from a turret are laterally radially movable outwardly, and can be selectively positioned at any site along such radial movement. In a preferred configuration, one turret is disposed near the forward end of the vessel, one turret is disposed at the center of the vessel, and one turret is disposed near the aft end of the vessel. The turbines preferably employed are those disclosed in my earlier-referenced copending application. An additional plurality of sets of two like turbines can be non-turret mounted on respective struts directly from the underside of the vessel, with each turbine of each set being spaced equidistantly on opposite sides from a measurement reference point on the longitudinal midline of the underside of the vessel.

Joined hull construction pieces of the vessel preferably comprise containment walls within which a single layer of a plurality of touching hollow spheres are sandwiched, and wherein a plurality of individual lengths of high strength stressed sheaths parallel with said containment walls and disposed within intrices formed by the spheres form a network of multiple connected lengths of respective sheaths within said walls to encircle the hull longitudinally and transversely thereto. The individual lengths of sheaths are disposed within respective individual tubes, and have means for adjusting stress applied to each of said lengths.

DETAILED DESCRIPTION OF PREFERRED EMBODIMENTS

Figure 1:
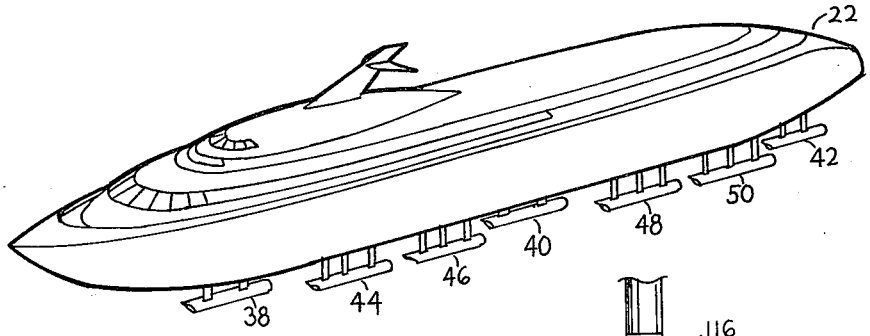
FIG. 1 is a perspective view of a water-going vessel.

Referring to FIG. 1, a water-going vessel 22 is shown. The vessel 22 is preferably totally electric, with such electricity preferably being generated through utilization of hydrogen fuel cells. Reference should be made to my earlier-referenced copending application relative to on-board generation of power.

Figure 4:
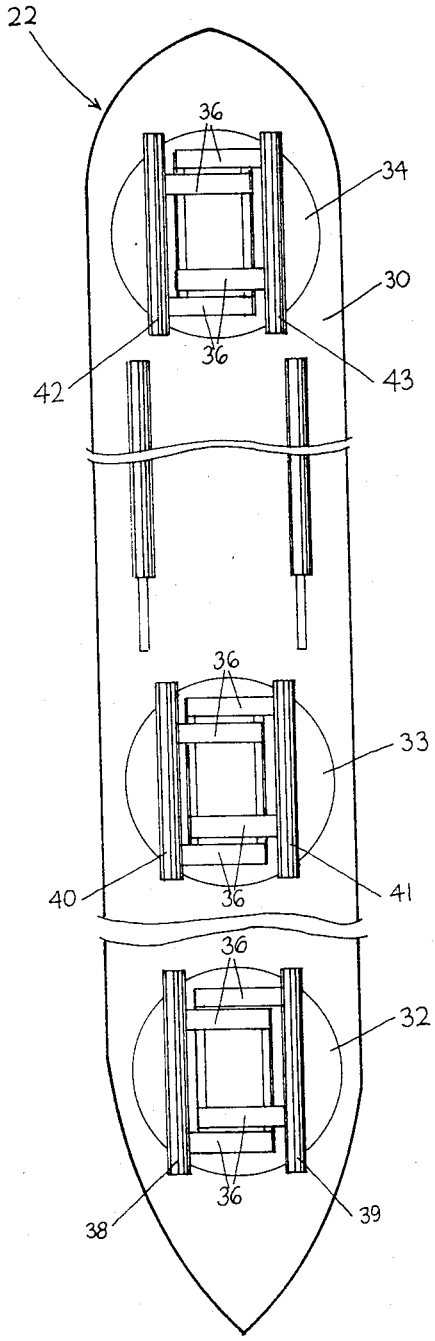
FIG. 4 is an underside plan view of the vessel of FIG. 1; with a portion thereof removed.
Figure 5:
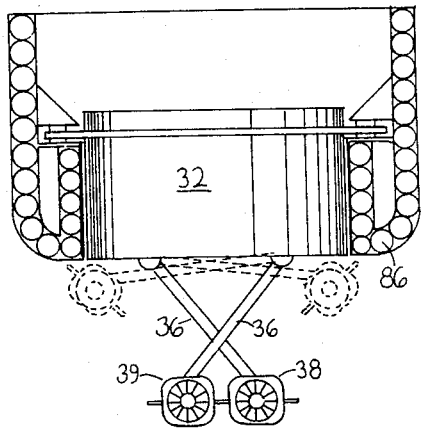
FIG. 5 is a front elevational view, partially in section, of a portion of the vessel of FIG. 1.
Figure 6:
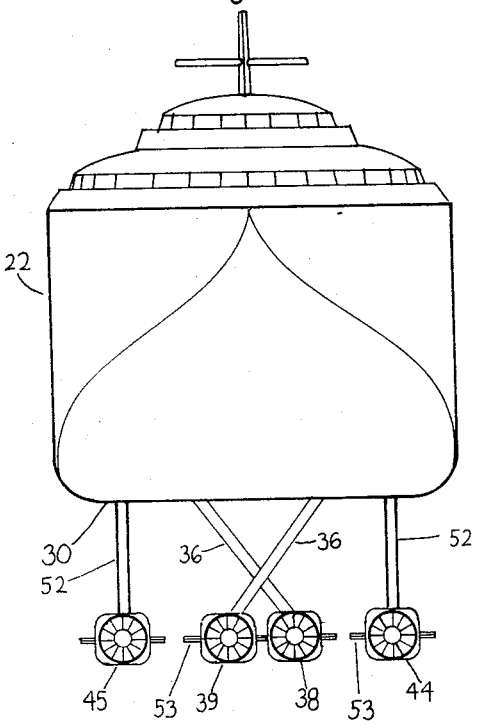
FIG. 6 is a front elevational view of the vessel of FIG. 1.

FIGS. 4, 5, and 6 illustrate preferred propulsion means for the Vessel 22. On the underside 30 as shown in FIG. 4 of said vessel 22 are disposed three turrets 32, 33, 34; one turret 32 near the forward end, one turret 33 at the center, and one turret 34 near the aft end. Said turrets 32, 33, 34 can rotate through 360 degrees, and are mounted and function as to rotatability as known generally in the art. Extending from each turret 32, 33, 34 are respective struts 36 upon which are mounted respective turbines 38, 39, 40, 41, 42, 43. As is shown, each turret 32, 33, 34 has one set of two turbines, with turbines 38 and 39 on struts extending from the forward turret 32; turbines 40 and 41 on struts extending from the center turret 33; and turbines 42 and 43 on struts extending from the aft turret 34. As is evident from the drawing, irrespective of the degree of rotation of a turret, each turbine of each set of two is always the same distance, on opposite sides, from the mid-point of turret pivot on the longitudinal midline of the underside 30 of the vessel 22.

The turbines 38, 39, 40, 41, 42, 43 are those as described in my earlier-referenced copending application, are mounted as there shown and described on the struts 36, and with the struts 36 having there within necessary air and power lines as described in said copending application. The struts 36 are retractable toward the underside 30 by being laterally radially movable outwardly so that the turbines 38, 40, 42 on the left side of the longitudinal midline of the underside 30 of the vessel 22 can be moved outwardly toward the left and upwardly on an arc to said underside 30, while the turbines 39, 41, 43 on the right side can be moved outwardly toward the right and upwardly. Further, travel of the struts 36 can be stopped at any position along the arc of turbine travel. Gear mechanisms as generally known in the art and housed inside the respective turret accomplish selectability of such position placement.

FIG. 5 illustrates the lateral movement positioning of the turbines 38, 39 accomplished by movement of the struts 36. Phantom lines show said turbines 38, 39 in a fully-retracted configuration, with the struts 36 likewise so shown. It is to be noted that, in regard to turbine illustration, FIG. 5 shows only turret-mounted turbines.

The interiors of the turrets 32, 33, 34 are essentially hollow except for gear mechanisms and turbine-operation fluid lines, with said interiors preferably under a positive air pressure generally provided as known in the art so that any break in a turret wall will result in a gas leak outwardly rather than a water leak inwardly. It is to be noted that the turrets 32, 33, 34 so pressurized can have an additional function as flotation tanks should the vessel be disabled.

In addition to turret-disposed turbines 38 through 43, the vessel 22 is provided with four tandem sets of two turbines mounted on respective struts 52 extending directly from the underside 30 of the vessel 22. FIG. 6 shows one set, turbines 44 and 45, and it is to be understood that each turbine 46, 48, 50 of FIG. 1 is one turbine of a respective set of two, disposed in like manner as illustrated in said FIG. 6 for turbines 44 and 45. Each turbine of each respective set of turbines is spaced equidistantly on opposite sides of the longitudinal midline of the underside of the vessel 22. These turbines, via their respective struts 52, are also retractable, with said struts 52 movable upwardly and rearwardly. The retraction mechanisms and the turbine strut-mountings are those as described in my earlier-referenced copending application. The struts 52 in the instant vessel 22, however, extend perpendicularly from the underside 30, rather than being angled laterally outwardly for vessel stability as shown in the copending application. In the instant vessel 22 stability principles as outlined in the copending application are accomplished via the turret-disposed turbines and the lateral angles which their respective struts 36 can attain. Pneumatically operated vanes 53 operable as generally known in the art in a vertical arc can be disposed laterally on the turbines to provide for quick maneuverability by overcoming the gyroscopic effect of the turbines in operation.

Figure 3:
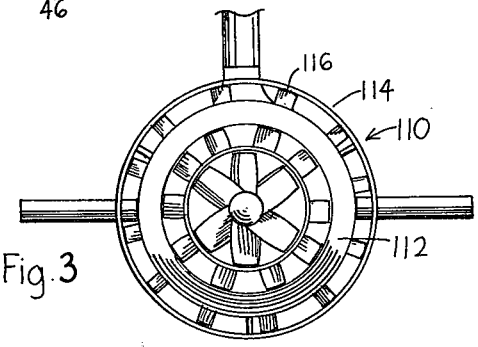
FIG. 3 is a front elevational view in section of the turbine of FIG. 2.
Figure 2:
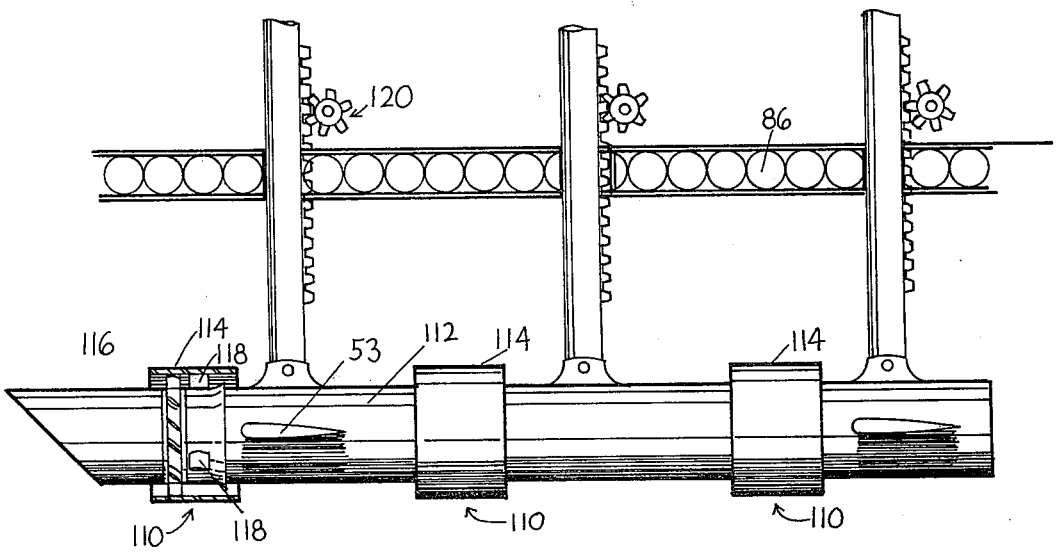
FIG. 2 is a side elevational view, partially in section, of one embodiment of a turbine.

While the turbines shown on the vessel 22 are those as described in my earlier-referenced copending application, a modified turbine 110, as shown in FIGS. 2 and 3, can be employed in place of those turbines as shown on the vessel 22. Within the outer wall 112 of the turbine 110, the internal operation of said turbine 110 is identical to that of those described in the copending application. Likewise, pneumatically operated vanes 53 are identical to those included on turbines numbered 38 through 51 of the vessel 22 here shown. However, in the turbine 110, a plurality, here, three, of individual tandemly positioned housings 114 surround respective portions of the outer wall 112. In FIG. 2, the front housing is shown in section. Within the forward portion of each housing 114 are mounted rotatable blades 116 which can be made to rotate on an axis equivalent to the longitudinal axis of the turbine 110. Said rotation is preferably powered electrically, and can be effectuated by cooperating interface surfaces between a stationary standard and a rotating standard upon which said blades 116 are mounted, as known in the art.

Immediately rearward of the blades 116 are a plurality of nozzle openings 118 which are in communication internally with a pressurized air, or other gas, source. Such pressurization is accomplished as generally known in the art. The pressurized air, or other gas, with air being preferred, exits the nozzle openings 118 in a path of flow directed along the outer wall 112 of the turbine 110, much in the same manner as air sweeps the inner wall of the turbines numbered 38 through 51, all as described in my earlier-referenced copending application. Such air shroud dispatched behind each of said housings 114 and surrounding the outer wall 112 of the turbine 110 reduces friction which would normally be present at the interface of water and said outer wall 112. In such manner, the flat plate area presented by the outer wall 112 is effectively reduced, thereby yielding greater power efficiency from the blades 116 as a vessel utilizing such turbines 110 propels through water. While the turbines numbered 38 through 43 on the vessel 22 shown throughout retract upwardly and rearwardly as disclosed in my earlier-referenced copending application, such retraction can alternatively be accomplished via direct upward retraction. Such direct upward retraction can be performed employing a gear drive 120 as shown in FIG. 2 and as would be recognizable by the skilled artisan.

The number of sets of two turbines is, of course, determined by the length of the vessel. Said vessel 22 here shown has an underside 30 which is 1,000 feet (305 meters) long, and has the appointment of turbines shown. Each turbine is 100 feet (30.5 meters) long. Reference should again be made to my earlier-referenced copending application which describes the turbine action in propelling a vessel, and which thereby provides information to the skilled artisan relative to the number of turbines required for particular vessel size.

Figure 7:
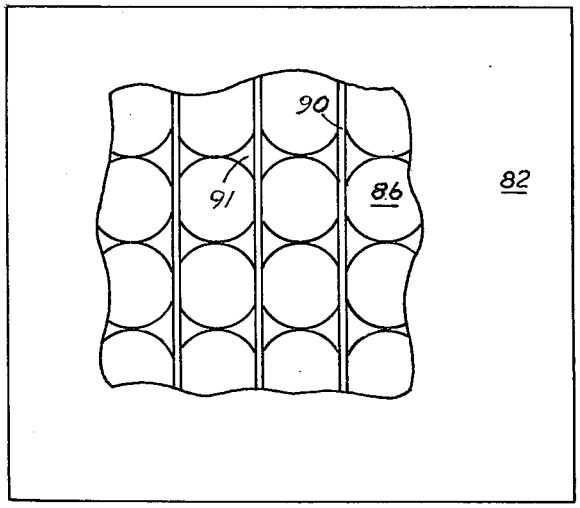
FIG. 7 is a partially cut-away side elevational view of internal construction of the hull of the vessel of FIG. 1.
Figure 8:
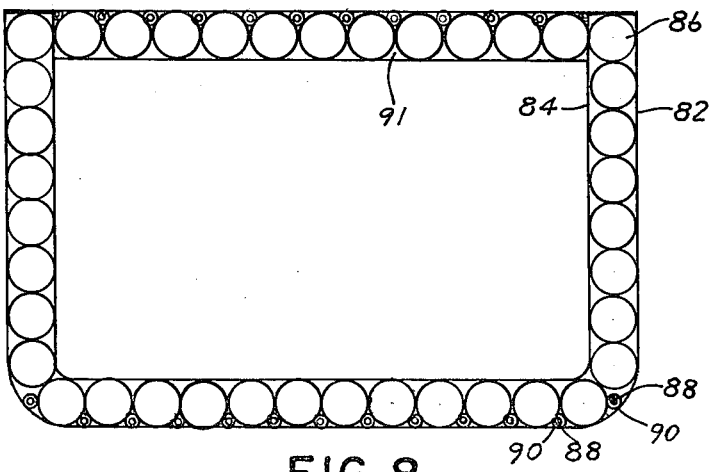
FIG. 8 is a cut-away front elevational view of the hull portion of the vessel of FIG. 1.
Figure 9:
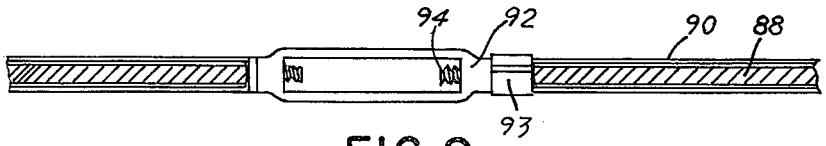
FIG. 9 is a side elevational view of a hull sheath connection, partially in section.

Hull construction of the vessel 22 is illustrated in FIGS. 2, 5, 7, and 8, and provides a pre-stressed structure shell which, because of being so pre-stressed, is capable of withstanding tremendous pressures. The structure sheets or hull construction pieces comprise an outer containment wall 82 and an inner containment wall 84 within which a single layer of a plurality of hollow spheres 86 are sandwiched. Said spherical wall construction is the same as that described in my earlier-referenced copending application. In addition, however, a plurality of individual lengths of high strength sheaths 88 within individual lengths of conduit-type tubes 90 shown in FIGS. 7 and 8 are disposed within intricies 91 formed by the spheres and are parallel with the containment walls 82, 84 to form a network of multiple continuous sheaths by connecting individual lengths to thereby encircle the hull longitudinally and transversely thereto. The sheaths 88, which are preferably constructed of plowshare wire or an equivalent, have stress adjustment couplings 92, as shown in FIG. 9, at appropriate intervals, preferably at each site where hull construction pieces are joined. For hull assembly purposes, each hull construction piece is provided with the tubes 90 during piece fabrication. After said pieces are assembled and the hull is thus constructed, individual sheaths 88 are threaded through respective tubes 90 for subsequent connection via couplings 92, or for anchoring at anchor sites as described below. As is evident from the drawing, each coupling 92, as shown in FIG. 9, permits the drawing together of each end of the meeting sheaths 88 with thread means 94 provided at each end of the lengths of sheaths to thereby permit adjustments of stress on each component of the multiple continuous sheath network. Where hatch openings into the interior of the hull are present, as well as openings for the turrets 32, 33, 34, continuity of the sheaths 88 destined for travel across such openings is, of course, interrupted, with the borders of such openings serving structurally as anchor sites for the sheaths 88 so involved. Anchoring is accomplished as is generally known in the art. Anchoring can also be accomplished through utilization of an appropriately-sized stopper sleeve 93 whose inside diameter is sized to permit movement of the sheath 88 there through, but which will not pass into the tube 90.

As described in my earlier-referenced copending application, the turbines employed are capable of propelling a vessel at high speed. Further, through use of vertically movably struts, with resultant turbine placement, the underside of said vessel, when cruising, is above the water line. In operation, then, the vessel 22 can travel in open seas and be configured for any use such as passenger use or cargo use. Forward movement of the vessel 22 is accomplished primarily by the turbines numbered 44 through 51 on struts 52 directly from the underside 30 of the vessel 22. Stability, turning capabilities, and lateral and backward movements are accomplished primarily by the turbines numbered 38 through 43 extending on struts 36 from the turrets 32, 33, 34. Thus, for example, the vessel 22 can travel in any direction, even backward, by appropriate rotation of the turrets, application of power to the turbines extending from said turrets, and cessation of power to non-turret mounted turbines numbered 44 through 51. Since the vessel 22 can move in its entirety in any chosen direction, docking procedures are most convenient, and any required emergency movements due to sea conditions, the avoidance of a collision, etc. can be accomplished rapidly and effectively. When the preferable hull construction described above is employed, the weight of a vessel is significantly reduced as compared to vessels of traditional construction, while the strength surpasses such traditional construction.

It is to be understood that the embodiments and features described above are illustrative and not limiting, and that the scope of the invention is defined in the claims which follow.

What is claimed is:

1. A water-going vessel having self-propulsion means comprising a plurality of parallel sets of two underwater turbines disposed along the underside of the vessel wherein each turbine is mounted at the end of individual retractable struts so that each turbine of each set is spaced equidistantly on opposite sides from a point on the longitudinal midline of the underside of the vessel, and further having a plurality of respective sets of two turbines wherein each turbine is mounted on respective struts extending from respective turrets disposed along the longitudinal midline of the underside of the vessel, with each turret having extending therefrom one set of turbines and with each turret rotatable through 360 degrees.

2. A water-going vessel as claimed in claim 1 wherein struts extending from a turret are laterally radially movable outwardly and can be selectively positioned at any site along such radial movement.

3. A water-going vessel as claimed in claims 1 or 2 wherein one turret is disposed near the forward end of the vessel, one turret is disposed at the center of the vessel, and one turret is disposed near the aft end of the vessel.

4. A water-going vessel as claimed in claim 1 wherein joined hull-construction pieces of the vessel comprise an outer containment wall and an inner containment wall within which a single layer of a plurality of touching hollow spheres is sandwiched, and wherein a plurality of individual lengths of high strength sheaths are within respective individual lengths of tubes which are parallel with the containment walls and disposed within intrices formed by the spheres, said individual lengths of sheaths having connection means to be connectable to each other to form a network of multiple continuous sheaths within said containment walls to encircle the hull longitudinally and transversely thereto, with said sheath connection means each comprising a coupling which can introduce stress within each length of sheath disposed within said network.

5. A water-going vessel as claimed in claim 1 wherein a plurality of housings surround respective portions of each turbine, each of said housings having therein a. rotatable blades rotatable on an axis equivalent to the longitudinal axis of the turbine; and b. immediately rearward of the rotatable blades a plurality of nozzle openings through which a gas under pressure can exit in a path of flow directed along the outer wall of said turbine.

6. A water-going vessel wherein joined hull construction pieces comprise an outer containment wall and an inner containment wall within which a single layer of a plurality of touching hollow spheres is sandwiched, and wherein a plurality of individual lengths of high strength sheaths are within respective individual lengths of tubes which are parallel with the containment walls and disposed within intrices formed by the spheres, said individual lengths of sheaths having connection means to be connectable to each other to form a network of multiple continuous sheaths within said containment walls to encircle the hull longitudinally and transversely thereto, with said sheath connection means each comprising a coupling which can introduce stress within each length of sheath disposed within said network.

* * * * *